US012798633B2

(12) United States Patent
Schafer et al.

(10) Patent No.: US 12,798,633 B2
(45) **Date of Patent: *Nov. 17, 2026**

(54) LOCKED-AXLE SPRING COMPRESSION SYSTEM AND METHOD

(71) Applicant: BNSF Railway Company, Fort Worth, TX (US)

(72) Inventors: Henry R. Schafer, Smithville, MO (US); Mike E. Teaford, Topeka, KS (US); Christopher M. Romero, Lawrence, KS (US); Edward M. Meyers, Grantville, KS (US); Timothy Webb, Topeka, KS (US); Ryan L. Kimberlin, Meriden, KS (US); Larry C. Valentine, Berryton, KS (US)

(73) Assignee: BNSF Railway Company

( * ) Notice: Subject to any disclaimer, the term of this patent is extended or adjusted under 35 U.S.C. 154(b) by 587 days.

This patent is subject to a terminal disclaimer.

(21) Appl. No.: 18/459,212

(22) Filed: Aug. 31, 2023

(65) Prior Publication Data

US 2024/0101166 A1 Mar. 28, 2024

Related U.S. Application Data

(63) Continuation of application No. 17/935,387, filed on Sep. 26, 2022, now Pat. No. 11,772,689.

(51) Int. Cl.
*B61F 5/32* (2006.01)
*B61F 1/08* (2006.01)
(Continued)

(52) U.S. Cl.
CPC ..... *B61F 5/32* (2013.01); *B61F 1/08* (2013.01); *B61F 5/301* (2013.01); *B61F 5/307* (2013.01); *B61K 5/02* (2013.01)

(58) Field of Classification Search
CPC .... B61F 5/32; B61F 1/08; B61F 5/301; B61F 5/36; B61F 5/307; B61K 5/02; B61K 5/00
See application file for complete search history.

(56) References Cited

U.S. PATENT DOCUMENTS 888,245 A * 5/1908 Maitland ..... B61K 5/00 254/33
4,502,391 A * 3/1985 Hurni ..... B60G 17/005 105/157.1
(Continued)

FOREIGN PATENT DOCUMENTS

CN 207728506 U * 8/2018
CN 112209293 A 1/2021
(Continued)

OTHER PUBLICATIONS

Maitland, L.G.; U.S. Patent Application; Jack; U.S. Appl. No. 888,245 ; Issued May 19, 1908.

*Primary Examiner* — Cheng Lin
(74) *Attorney, Agent, or Firm* — Whitaker Chalk Swindle & Schwartz PLLC; Bradley J. Birchfield; Enrique Sanchez, Jr.

(57) ABSTRACT

A locked-axle spring compression system and method configured to raise a rail vehicle wheel off a rail and transport the raised wheel along a rail is presented. In one embodiment, the present disclosure discloses a system that can raise the locked-axle rail wheel off the rail and allowing the locked-axle train to be transported off the main line. One or more coil springs can be disposed between the truck frame and the journal box to distribute the weight of the train and forces acting thereon. The present disclosure provides a technological solution missing from conventional systems by at least providing a platform for an actuator configured to exert a force on one or more train elements to compress the
(Continued)

coil springs and allow the locked-axle wheel to be raised off a surface (e.g., railroad track rail), by overcoming the coil spring pressure to raise the wheel off the rail.

20 Claims, 11 Drawing Sheets

(51) Int. Cl.
*B61F 5/30* (2006.01)
*B61K 5/02* (2006.01)

(56) References Cited

U.S. PATENT DOCUMENTS 5,018,453 A * 5/1991 Kinard ..... B61D 15/00 105/72.2
5,203,264 A * 4/1993 Sodder, Jr. ..... B61K 5/02 104/263
8,171,829 B2 * 5/2012 Thyni ..... B61K 5/00 82/128
8,468,952 B2 * 6/2013 Worden ..... B61F 5/36 105/157.1
9,925,991 B2 3/2018 Hou et al.
10,710,614 B2 * 7/2020 Taga ..... B61F 5/36
10,766,508 B2 * 9/2020 Taga ..... B61F 5/302
11,124,398 B2 9/2021 Moore
11,772,689 B1 * 10/2023 Schafer ..... B61F 5/301 105/215.1
2009/0095196 A1 4/2009 Kumar et al.
2015/0165853 A1 * 6/2015 Smith ..... F16F 13/002 267/35
2019/0107361 A1 4/2019 Salehi

FOREIGN PATENT DOCUMENTS

RU 2496627 C1 * 10/2013
WO WO-2012027520 A1 * 3/2012 ..... B61F 5/36
WO 2020074197 A1 4/2020

* cited by examiner

LOCKED-AXLE SPRING COMPRESSION SYSTEM AND METHOD

CROSS-REFERENCE TO RELATED APPLICATIONS

The present application is a Continuation of U.S. patent application Ser. No. 17/935,387, filed Sep. 26, 2022, the entirety of which is hereby incorporated by reference for all purposes.

TECHNICAL FIELD

The present disclosure relates generally to locked-axle rail wheels, and more specifically to a journal box coil spring compression system configured to raise and transport a locked-axle wheel.

BACKGROUND

As rail vehicles travel over a rail, they can become damaged by many hazards along the trip. Such damage can cause the rail vehicle to malfunction. One particularly troublesome malfunction is when an axle of a rail vehicle (e.g., locomotive, railcar, or other suitable vehicle) locks up and prevents the wheels of the rail vehicle from traversing a railroad track. Such condition can cause irreparable damage to the rail vehicle or even derailment. When a rail vehicle axle locks up during operation, the effect is that the main line stopped. Further, staffing is affected as the current crew will typically be released to work on another train crew or rest. After losing a train crew, a first responder must be deployed to address the locked axle. Once the locked axle is identified, another response team must be deployed to address the locked axle. The locked axle rail vehicle is then transported via various means to a service location. The train having a locked axle must then wait for another crew to arrive to transport the train to its intended destination. Such delays can impact heavy losses for a railroad operator. Moreover, the losses are compounded as it is not only the effect of a particular locked-up rail vehicle, but every other train behind that has to stop. With hundreds of locked axle events every year, the effect on railroad operations cannot be overstated.

Traditional solutions to this problem have included: hiring an "oiler" to oil the railroad track to allow the wheel to "skid" to the nearest service location, cutting the fittings, or using a crane to lift the locked-axle rail vehicle off the line. The difficulties with having an oiler on hand is the labor burden of walking with a train for miles, periodically applying oil to the wheel or track, until the service location is reached. When cutting the pinion, there are many hazards that can cause harm to the responder and the rail vehicle including under-locomotive environment hazards and weather considerations. Employing a crane adds time and expense to the process, including blocking the main line. Other train wheel dollies exist, but they typically require a crane to lift the train to position the locked-axle wheel on a dolly. Understandably, these dollies are rarely used since a rail vehicle is already being lifted with a crane, replacement of the offending axle may be just as easy.

SUMMARY

The present disclosure achieves technical advantages as a locked-axle spring compression system and method configured to raise a rail vehicle wheel off a rail and transport the raised wheel along a rail. In one embodiment, the present disclosure discloses a system that can raise the locked-axle rail wheel off the rail with no crane, thereby allowing the train with a locked axle to be transported off the main line in a shorter period of time. A train can include a truck frame having a journal box (a/k/a captain's hat) operably coupled to the rail vehicle axle and the truck frame. One or more coil springs can be disposed between the truck frame and the journal box to distribute the weight of the train and forces acting thereon. The present disclosure solves the technological problem of how to address locked-axles on a train that occur during travel.

The present disclosure provides a technological solution missing from conventional systems by at least providing a platform for an actuator (e.g., a hydraulic cylinder, jack, air bag, or other suitable lifting mechanism) configured to exert a force on one or more train elements to compress the coil springs and allow the locked-axle wheel to be raised off a surface (e.g., railroad track rail), by overcoming the coil spring pressure to raise the wheel off the rail. In one embodiment, the actuator can be coupled to a vehicle frame (e.g., a train truck frame) and exert a force away from the platform to bring about the compression of one or more coil springs. As the coil springs proximate a locked-axle rail wheel are compressed, the train weight exerted on the rail wheel is released causing the rail wheel to rise off of the surface.

The system provides the technological benefit of no longer having to use a crane or slide a locked-axle rail vehicle to the next siding or repair location. The system can be deployed within minutes to get the locomotive moving again to relieve mainline congestion.

It is an object of the invention to provide a locked-axle rail wheel spring compression system. It is a further object of the invention to provide a locked-axle spring compression system. It is a further object of the invention to provide a method of lifting a locked-axle wheel by compressing a coil spring. These and other objects are provided by at least the following embodiments.

In one embodiment, a locked-axle spring compression system, can include: a base plate having a top side and a bottom side, with one or more bolt holes disposed therethrough; an extender having a bolt channel coupled to the top side of the base plate; a bolt disposed through the bolt hole from the bottom side of the base plate and through the bolt channel; and an actuator coupled to the top side of the base plate. Further comprising at least one actuator hole disposed through the base plate and configured to receive an actuator screw or stud. Wherein the actuator is disposed between the base plate and a vehicle structure. Wherein the bolt couples the base plate and the extender to a vehicle structure. Wherein the actuator extends a ram to exert a force on a journal box. Wherein the force compresses a coil spring disposed proximate the journal box. Further comprising a gauge box coupled to the actuator. Further comprising a pump operably coupled to the gauge box.

In another embodiment, a locked-axle rail wheel spring compression system, can include: a vehicle frame; a base plate having a top side and a bottom side, with one or more bolt holes disposed therethrough; an extender having a bolt channel coupled to the top side of the base plate; a bolt disposed through the bolt hole from the bottom side of the base plate, through the bolt channel, and operably coupled to the vehicle frame; a actuator coupled to the top side of the base plate; and a spacer disposed between the vehicle frame and a journal box. Further comprising at least one actuator hole disposed through the base plate and configured to receive an actuator screw or stud. Wherein the actuator is disposed between the base plate and the vehicle frame. Wherein the bolt couples the base plate and the extender to the vehicle frame. Wherein the actuator extends a ram to exert a force on the journal box. Wherein the force compresses a coil spring disposed proximate the journal box. Further comprising a gauge box coupled to the actuator. Further comprising a pump operably coupled to the gauge box.

In another embodiment, a method of lifting a locked-axle wheel by compressing a coil spring, can include: coupling a locked-axle spring compression system having a base plate, an extender, and an actuator to a vehicle frame proximate a locked-axle rail wheel; exerting a force, via the actuator, on a journal box operably coupled to the vehicle frame; and compressing a coil spring disposed proximate the journal box to raise the locked-axle wheel off a surface. Further comprising installing a spacer between the vehicle frame and a second journal box. Wherein the actuator is a hydraulic cylinder, jack (e.g., bottle jack), airbag, mechanical arm, or other suitable lifting device. Wherein the locked-axle spring compression system further includes a gauge box coupled to the actuator.

BRIEF DESCRIPTION OF THE DRAWINGS

The present disclosure will be readily understood by the following detailed description, taken in conjunction with the accompanying drawings that illustrate, by way of example, the principles of the present disclosure. The drawings illustrate the design and utility of one or more exemplary embodiments of the present disclosure, in which like elements are referred to by like reference numbers or symbols. The objects and elements in the drawings are not necessarily drawn to scale, proportion, or precise positional relationship. Instead, emphasis is focused on illustrating the principles of the present disclosure.

DETAILED DESCRIPTION

The disclosure presented in the following written description and the various features and advantageous details thereof, are explained more fully with reference to the non-limiting examples included in the accompanying drawings and as detailed in the description. Descriptions of well-known components have been omitted to not unnecessarily obscure the principal features described herein. The examples used in the following description are intended to facilitate an understanding of the ways in which the disclosure can be implemented and practiced. A person of ordinary skill in the art would read this disclosure to mean that any suitable combination of the functionality or exemplary embodiments below could be combined to achieve the subject matter claimed. The disclosure includes either a representative number of species falling within the scope of the genus or structural features common to the members of the genus so that one of ordinary skill in the art can recognize the members of the genus. Accordingly, these examples should not be construed as limiting the scope of the claims.

A person of ordinary skill in the art would understand that any system claims presented herein encompass all of the elements and limitations disclosed therein, and as such, require that each system claim be viewed as a whole. Any reasonably foreseeable items functionally related to the claims are also relevant. A patent examiner, after having obtained a thorough understanding of the disclosure and claims of the present application has searched the prior art as disclosed in patents and other published documents, e.g., non-patent literature. Therefore, as evidenced by issuance of this patent, the prior art fails to disclose or teach the elements and limitations presented in the claims as enabled by the specification and drawings, such that the presented claims are patentable under the applicable laws and rules of this jurisdiction.

Figure 1:
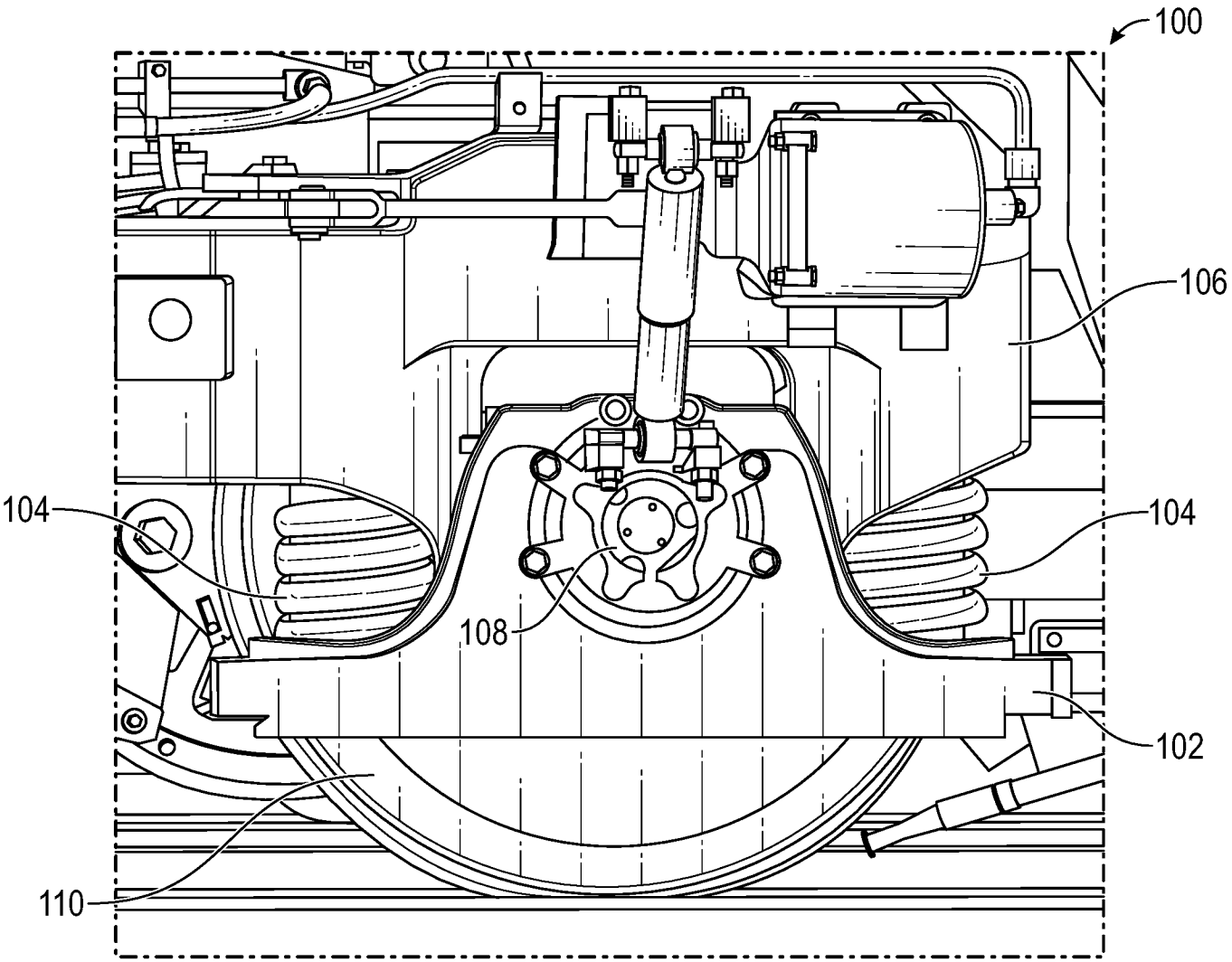
FIG. 1 illustrates a side-view of a portion of a train wheel assembly, in accordance with one or more exemplary embodiments of the present disclosure.

FIG. 1 illustrates a side-view of a portion of a train wheel assembly 100, in accordance with one or more exemplary embodiments of the present disclosure. In one embodiment, a journal box (a/k/a captain's hat) 102 can be the mechanical subassembly on each end of the axles under a rail vehicle (train), such as a railcar or locomotive. A train can include a truck frame 106 having a journal box 102 operably coupled to the rail vehicle axle assembly 108 and the truck frame. The rail vehicle axle assembly 108 can contain bearings and thus transfer the rail vehicle weight to the journal box 102, rail wheels 110 and rails. The bearings can be roller bearings. One or more coil springs 104 can be disposed between the truck frame 106 and the journal box 102 to distribute the weight of the train and forces acting thereon. The journal box coil springs 104 can be disposed on either side of the rail vehicle axle assembly 108 of a train. The coil spring 104 can be a helical compression spring. The coil springs 104 can ensure the proper distribution of weight to the various wheels 110 of the rail vehicle. As such the coil springs 104 impress the weight of the locomotive onto the journal box 102 and then onto the rail vehicle wheels 110.

Figure 2A:
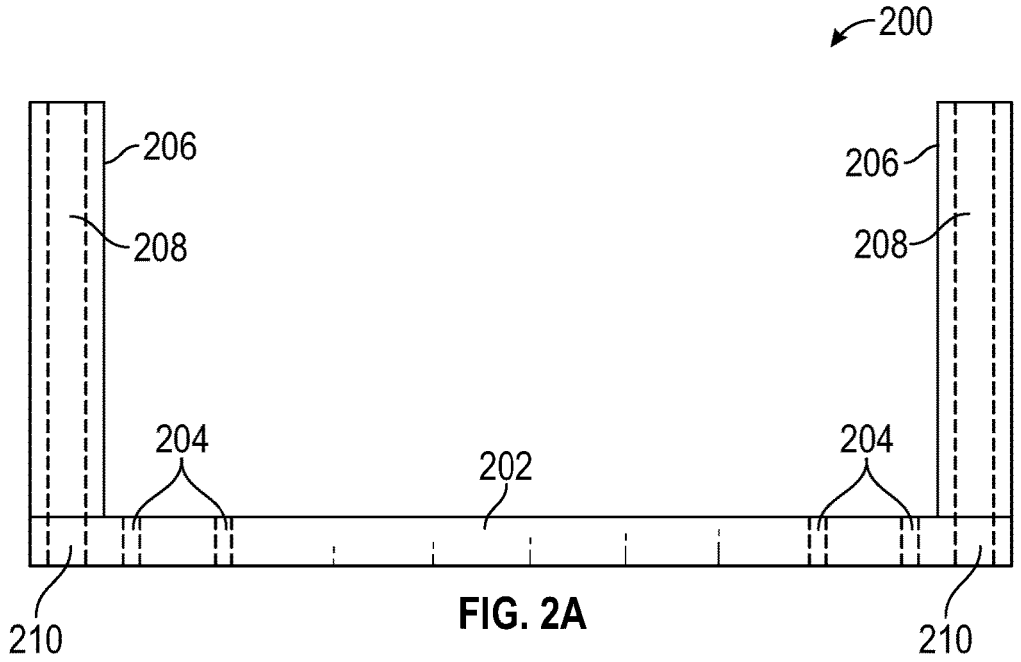
FIG. 2A illustrates a side-view of a platform of a locked-axle spring compression system, in accordance with one or more exemplary embodiments of the present disclosure.

FIG. 2A illustrates a side-view of a platform 200 of a locked-axle spring compression system, in accordance with one or more exemplary embodiments of the present disclosure. In one embodiment, the platform 200 can include a base plate 202. The base plate 202 can include actuator holes 204 and bolt holes 210. In another embodiment, the platform 200 can include one or more extenders 206. The extenders 206, can include a bolt channel 208 disposed therethrough. In another embodiment, a base plate 202 can include a top side and a bottom side, with one or more bolt holes 210 disposed therethrough, an extender 206 having a bolt channel 208 can be coupled to the top side of the base plate 202, a bolt can be disposed through the bolt hole 210 from the bottom side of the base plate 202 and through the bolt channel 208. In another embodiment, all platform elements can be made of metal (e.g., ANSI 1018 steel). In another embodiment, the bolt channel 208 and the bolt hole 210 can be sized and shaped to receive a bolt therethrough. For example, the bolt channel 208 and the bolt hole 210 can be aligned to facilitate insertion of the bolt through the base plate 202 and the extender 206. In another embodiment, the extender 206 can have a length at least as long as an actuator selected for mounting on base plate 202. For example, the extender 206 can be 8.5" long and 1.5" wide. The extender can have a cross section of a circle, square, triangle, polygon, or other suitable shape or contour.

Figure 2B:
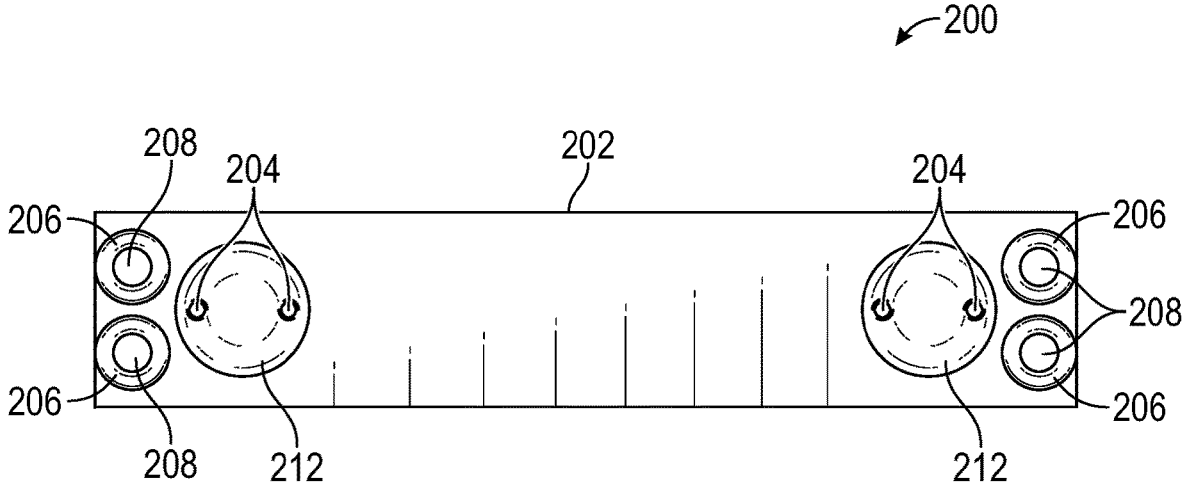
FIG. 2B illustrates a top-view of the platform of a locked-axle spring compression system, in accordance with one or more exemplary embodiments of the present disclosure.

FIG. 2B illustrates a top-view of the platform 200 of a locked-axle spring compression system, in accordance with one or more exemplary embodiments of the present disclosure. In one embodiment, the base plate 202 can be configured to receive at least one actuator 212 disposed in an actuator area proximate one or more actuator holes 204. For example, the actuator 212 can be any type of lifting mechanism, including a floor jack, bottle jack, air hydraulic jack, inflatable jack, cylinder, motorized arm, or other suitable device, and the actuator area can be contoured to accommodate an actuator 212. In another embodiment, the actuator 212 can include one or more screws on one end to couple the actuator to the base plate 202. For example, the screws can be disposed through the actuator holes 204 in base plate 202 and secured on the other side via a nut, wing nut, pin, or other suitable device. In another embodiment, the actuator 212 can include one or more studs on one end to couple the actuator to the base plate 202. For example, the studs can be disposed through the actuator holes 204 in base plate 202 without further securing the actuator 212 to the base plate 202. The extenders 206 and the actuator can be disposed proximate the edges of base plate 202, the center of base plate 202, both the edges and the center of base plate 202, or any suitable location on base plate 202.

Figure 3A:
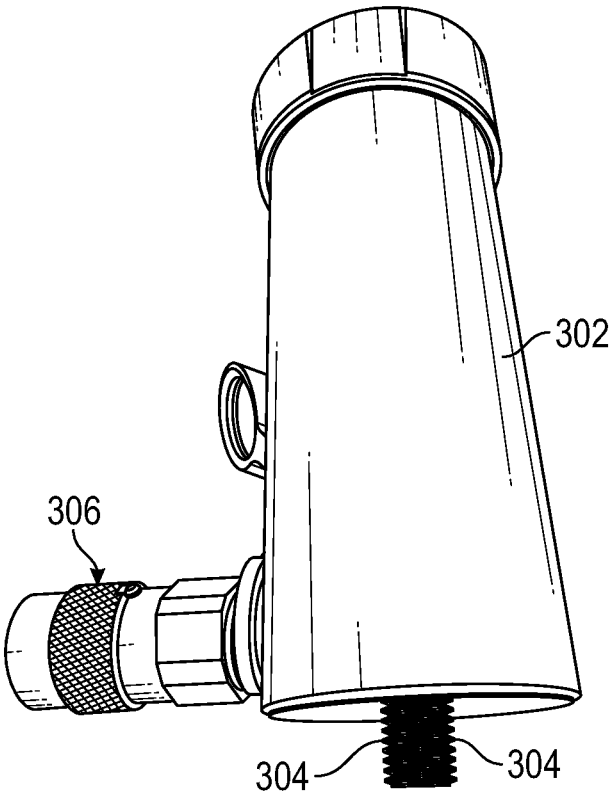
FIG. 3A illustrates a perspective-view of an actuator, in accordance with one or more exemplary embodiments of the present disclosure.

FIG. 3A illustrates a perspective-view of an actuator 302, in accordance with one or more exemplary embodiments of the present disclosure. In one embodiment, the actuator 302 can be a hydraulic cylinder (bottle jack). In one example, the hydraulic cylinder can be a jack which resembles a bottle in shape, having a cylindrical body and a neck. Within the hydraulic cylinder can be disposed a vertical lifting ram. The actuator 302 may be pneumatic, hydraulic, or work by screw action. In another embodiment, the actuator 302 can have an adaptor 306 configured to engage one or more hoses to receive a fluid, such as air, water, oil, or other suitable fluid. In the pneumatic version, in one embodiment, pressurized fluid can be used to operate the actuator. In another embodiment, the actuator 302 can be a hydraulic jack actuated by compressed air—for example, air from a compressor—instead of human work. This eliminates the need for the user to actuate the hydraulic mechanism, saving effort and potentially increasing speed. Sometimes, such jacks are also able to be operated by the manual hydraulic actuation, retaining hand operation functionality even if a source of compressed air is not available. In the hydraulic version, in another embodiment, the hydraulic ram can emerge from the body vertically by hydraulic pressure provided by a pump either on the baseplate or at a remote location via a hose (e.g., a pressure hose). For example, for lifting heavy structures the hydraulic interconnection of multiple vertical jacks through valves enables the even distribution of forces while enabling close control of the lift. In another embodiment, the screw version of the actuator works by turning a large nut running on the threaded vertical ram at the neck of the body. The nut can include gear teeth and can be generally turned by a bevel gear coupled to the body, the bevel gear being turned manually by a jack handle fitting into a socket. In another embodiment, the ram may have a second screwed ram within it, which doubles the lifting range telescopically.

Figure 3B:
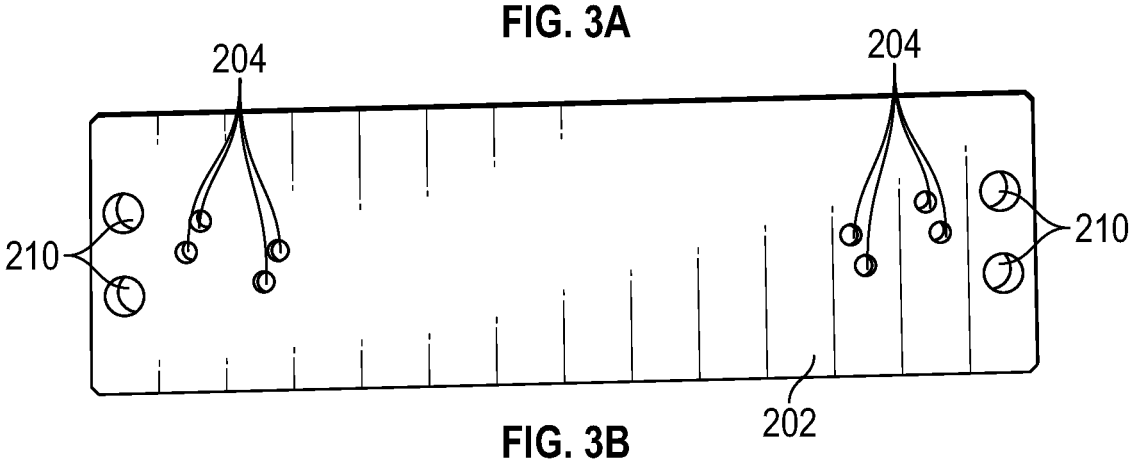
FIG. 3B illustrates a top-view of a base plate, in accordance with one or more exemplary embodiments of the present disclosure.

FIG. 3B illustrates a top-view of a base plate 202, in accordance with one or more exemplary embodiments of the present disclosure. The base plate 202 can include multiple holes to receive one or more system components. For example, the base plate 202 can include actuator holes 204, bolt holes 210, or other suitable holes. The corresponding bolt holes 210 and actuator holes 204 can be positioned anywhere on base plate 202 to correspond with the location of a respective extender 206 or actuator 302.

Figure 3C:
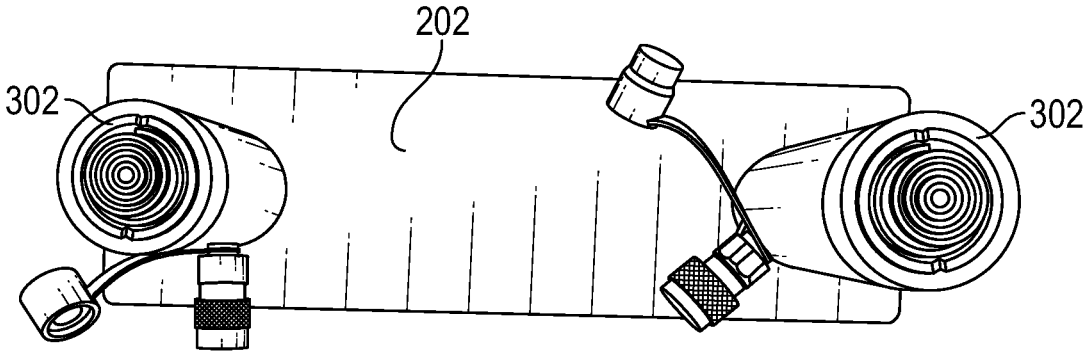
FIG. 3C illustrates a perspective-view of a base plate with actuators, in accordance with one or more exemplary embodiments of the present disclosure.

FIG. 3C illustrates a perspective-view of a base plate 202 with actuators 302, in accordance with one or more exemplary embodiments of the present disclosure. In one embodiment, actuators can be positioned on the base plate 202 to provide directed lift to an area. In another embodiment, the actuators 302 can be coupled to the base plate 202 to direct rams away from the base plate to lift an object away from the base plate 202. In another embodiment, the actuators 302 can be coupled to the base plate 202 to direct rams away from the base plate to push the base plate 202 away from an object. In another embodiment, when the platform is secured to a vehicle frame, the actuators 302 can push away from the base plate 202 to compress an object (e.g., coil springs of a journal box).

Figure 4:
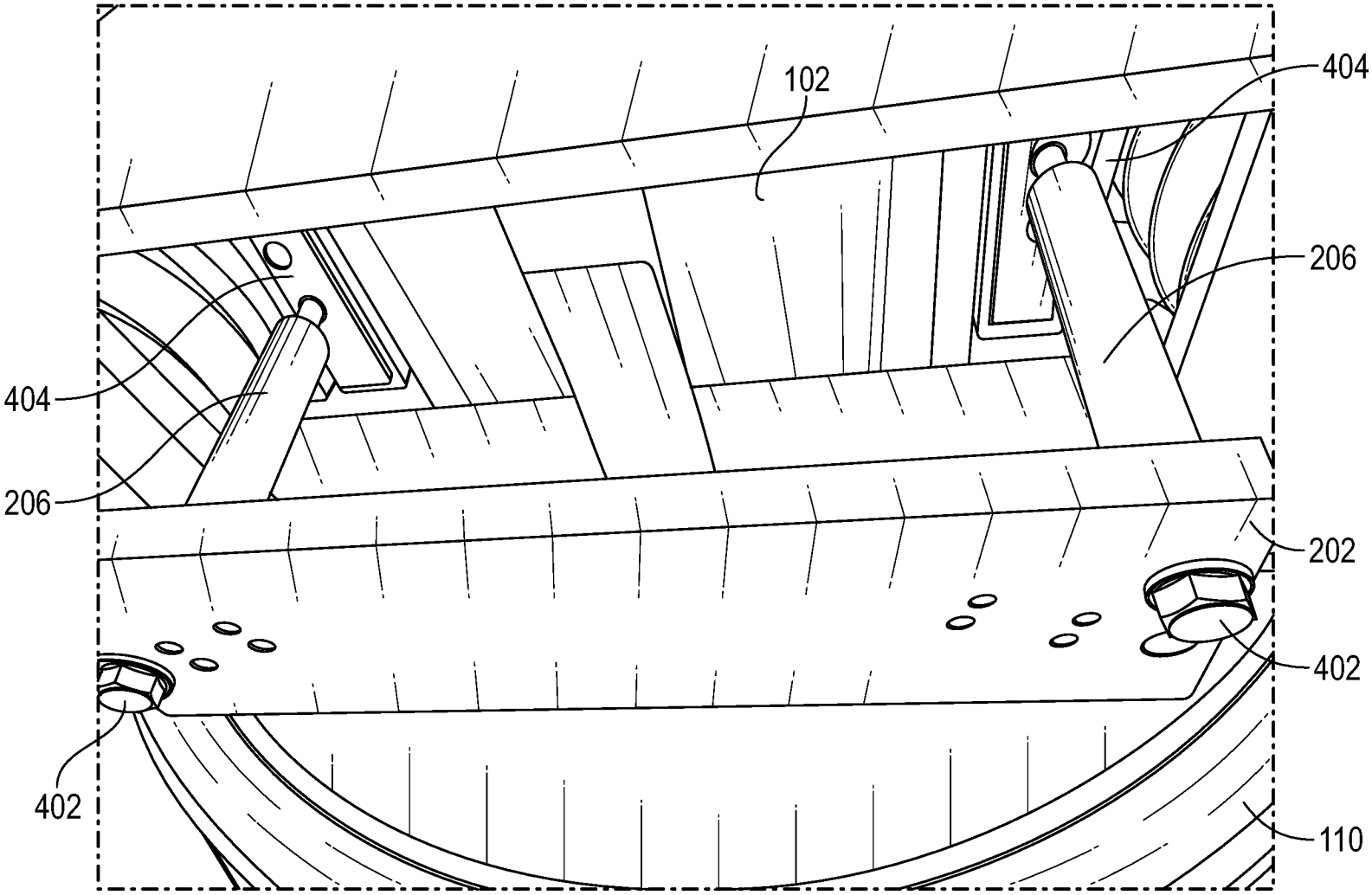
FIG. 4 illustrates a perspective-view of a platform of a locked-axle spring compression system coupled to a vehicle frame, in accordance with one or more exemplary embodiments of the present disclosure.

FIG. 4 illustrates a perspective-view of a platform of a locked-axle spring compression system coupled to a vehicle frame proximate a rail wheel 110, in accordance with one or more exemplary embodiments of the present disclosure. In one exemplary embodiment, the platform can include a base plate 202 with at least two extenders 206 disposed thereon. A bolt 402 can be disposed through the base plate 202 and each extender 206 to be screwed into one or more frame holes. For example, the vehicle frame can be a train truck frame with one or more truck jaws 404 extending therefrom. In another embodiment, a journal box 102 can be operably coupled to the truck frame with one or more openings allowing access to the truck frame or truck frame elements (e.g., truck jaws 404).

Figure 5:
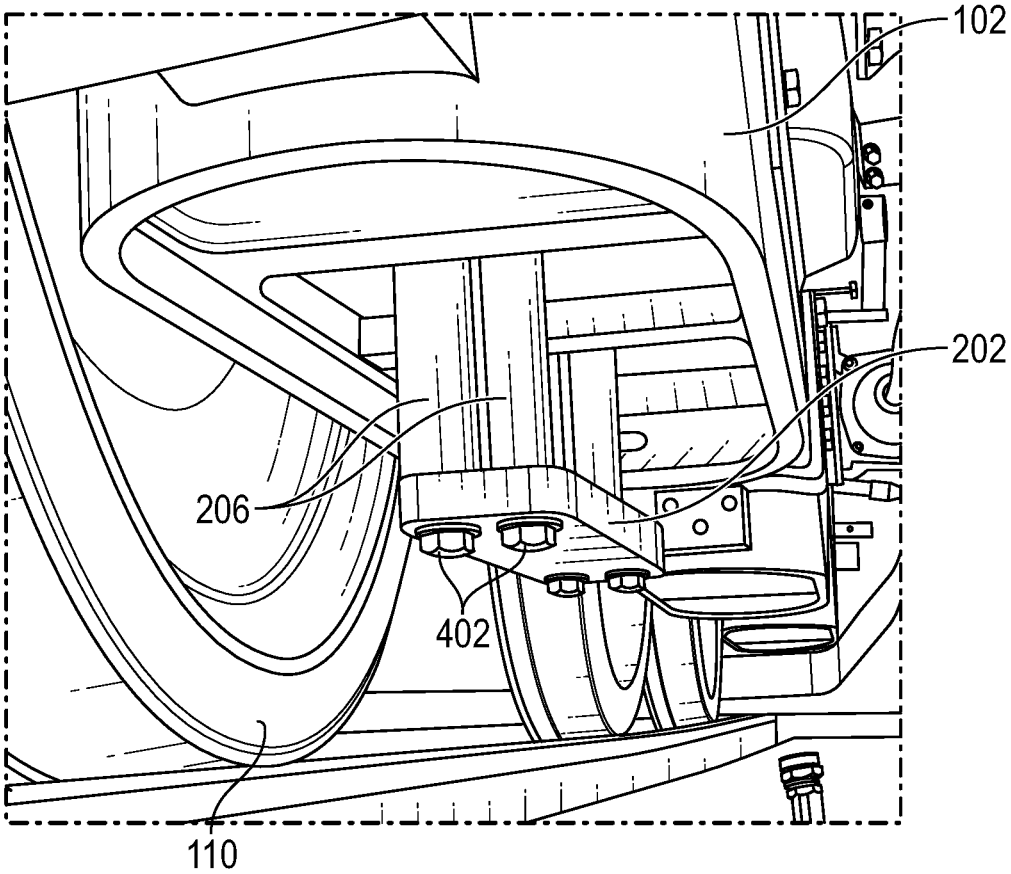
FIG. 5 illustrates a perspective-view of another platform of a locked-axle spring compression system coupled to a vehicle frame, in accordance with one or more exemplary embodiments of the present disclosure.

FIG. 5 illustrates a perspective-view of another platform of a locked-axle spring compression system coupled to a vehicle frame, in accordance with one or more exemplary embodiments of the present disclosure. In one exemplary embodiment, the platform can include a base plate 202 with at least four extenders 206 disposed thereon. A bolt 402 can be disposed through the base plate 202 and each extender 206 to be screwed into one or more frame holes to secure the platform to the vehicle frame. For example, the vehicle frame can be a train truck frame with one or more truck jaws extending therefrom. In another embodiment, a journal box 102 can be operably coupled to the truck frame with one or more openings allowing access to the truck frame or truck frame elements (e.g., truck jaws 404).

Figure 6:
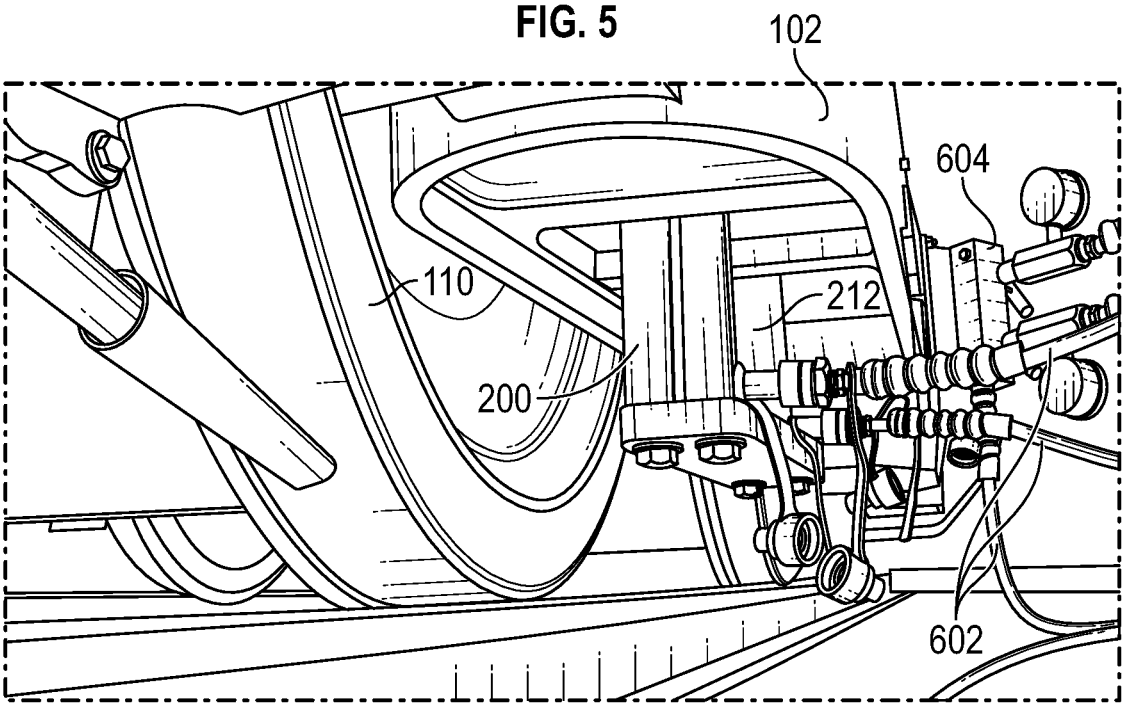
FIG. 6 illustrates a perspective-view of a locked-axle spring compression system coupled to a vehicle frame and hoses, in accordance with one or more exemplary embodiments of the present disclosure.

FIG. 6 illustrates a perspective-view of a locked-axle spring compression system coupled to a vehicle frame and hoses 602, in accordance with one or more exemplary embodiments of the present disclosure. In one embodiment, the platform 200 can have at least one actuator 212 (or other lifting device) coupled thereto. In another embodiment, one or more hoses 602 can couple a gauge box 604 to the actuator 212. For example, the gauge box 604 can include one or more gauges, corresponding with each actuator 212 to monitor and apply fluid to the actuators 212. In another embodiment, the gauge box can include one or more magnets to adhere the gauge box to the train (e.g., the journal box 102). The gauges of gauge box 604 can indicate the pressure exerted or maintained by each actuator (e.g., hydraulic cylinder) 212. In another embodiment, a hose 602 can couple the gauge box 604 to an external device, such as a pump. For example, a pump can provide fluid to the gauge box 604, which can then distribute the fluid to the actuators to control the actuator.

Figure 7:
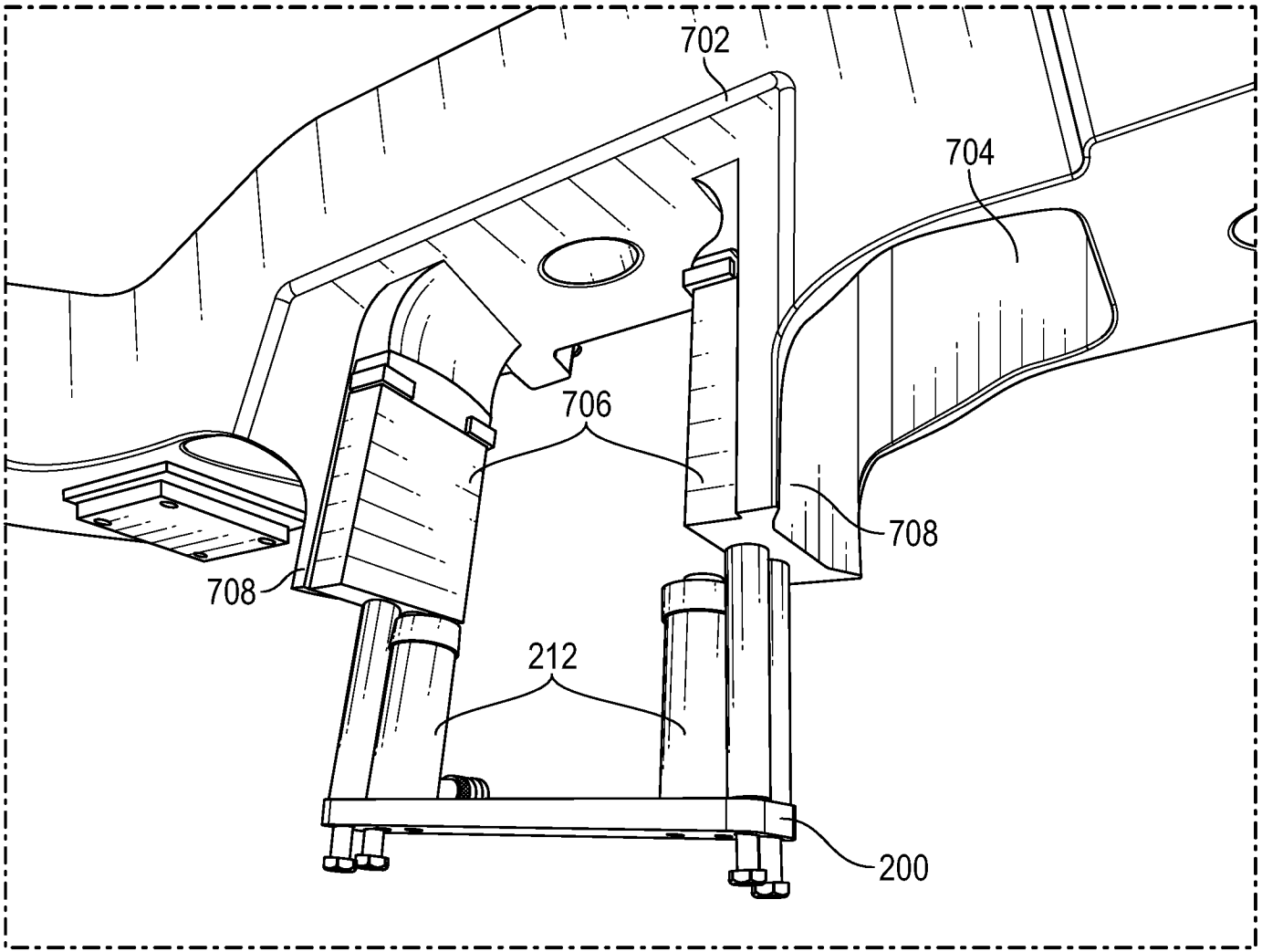
FIG. 7 illustrates a perspective-view of a platform of a locked-axle spring compression system coupled to a vehicle frame without a journal box and axle, in accordance with one or more exemplary embodiments of the present disclosure.

FIG. 7 illustrates a perspective-view of a platform 200 of a locked-axle spring compression system coupled to a vehicle frame (e.g., truck frame) 702 without a journal box and axle, in accordance with one or more exemplary embodiments of the present disclosure. In one embodiment, a vehicle frame 702 can include a coil spring well 704 configured to receive one end of a coil spring. The other end of the coil spring can be operably coupled to a coil spring well of a journal box 102. The truck frame 702, can also include one or more elements such as truck jaws 708. One or more pedestal liners 706 can be coupled to a face of a truck jaw 708. In another embodiment, the truck jaws 708 can include one or more threaded holes configured to receive a bolt, screw, or other threaded device. For example, the j-block bolts coupling j-blocks to the truck jaws 708 can be removed and the j-block bolt holes utilized to couple the platform 200 to the truck frame 702. In another embodiment, the j-blocks decoupled from the truck jaws 708 can be used as spacers disposed between the journal box 102 and the truck frame 702. In another embodiment, the bolts of platform 200 can be disposed through the bolt holes 210 of the base plate 202 and the bolt channels 208 of the extenders 206, and into the threaded holes of the truck jaws 708, to provide a secure coupling of the platform 202 the truck frame 702. In another embodiment one or more actuators 212 can be coupled to the platform 200 with the ram ends of the actuator 212 pointed towards the truck frame 702. In this way, in one embodiment, the platform 200 can be securely coupled to the truck frame such that operation of the actuators 212 can cause compression between the actuators 212 and the truck frame 702. For example, when fully assembled, the actuators 212 can lift the journal box 102 toward the truck frame 702, causing the coil springs disposed between the coil spring well 704 of the truck frame 702 and the coil spring well of the journal box 102 to compress, thereby overcoming the coil spring pressure exerted on the wheel to raise the wheel off the surface.

Figure 8:
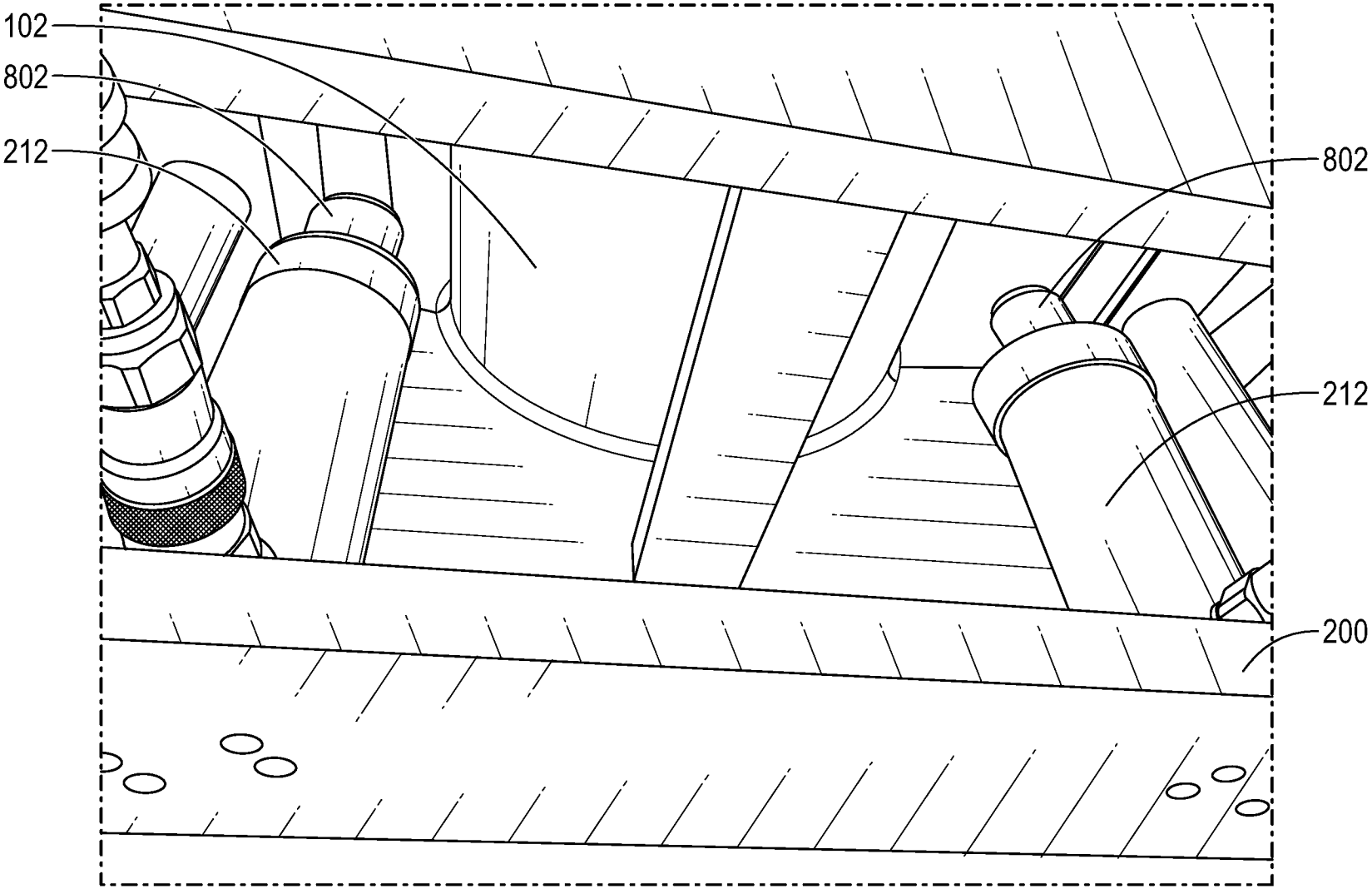
FIG. 8 illustrates a perspective-view of a locked-axle spring compression system coupled to a vehicle frame with a journal box, in accordance with one or more exemplary embodiments of the present disclosure.

FIG. 8 illustrates a perspective-view of a platform 200 of a locked-axle spring compression system coupled to a vehicle frame with a journal box 102, in accordance with one or more exemplary embodiments of the present disclosure. In one embodiment, one or more actuators 212 can be coupled to the platform 200. Hoses can be operably coupled to an adapter of each respective actuator 212. In another embodiment, when fluid is provided to the actuators 212 via the adapters, the pressure within the actuator 212 rises, causing a lifting ram 802 disposed within each actuator 212 to extend out of each actuator 212. As the lifting ram 802 rises out of a respective actuator 212, the lifting ram 802 comes into contact with a portion of the journal box 102. Since the platform 200 can be securely coupled to the truck frame 702, as the lifting ram 802 extends away from the platform 200, it pushes the journal box 102 away from the platform 200 causing compression of the coil springs proximate the platform 200.

Figure 9:
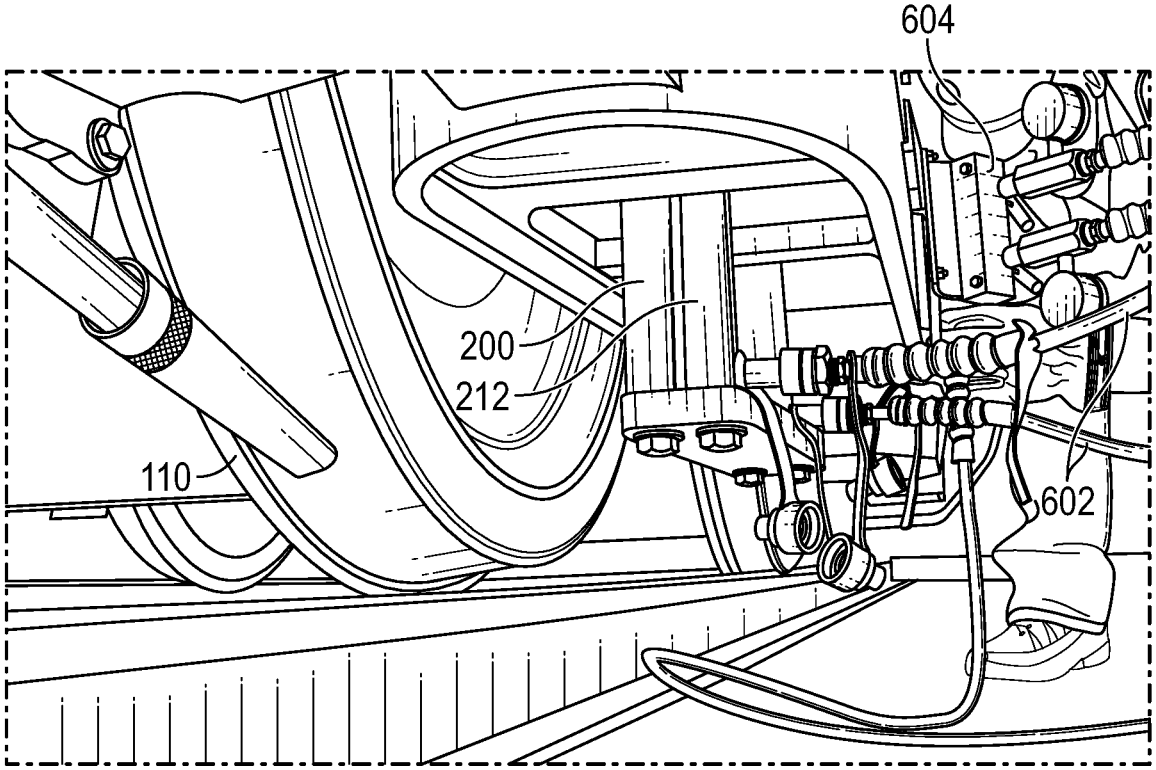
FIG. 9 illustrates a perspective-view of a locked-axle spring compression system coupled to a vehicle frame with a raised rail wheel, in accordance with one or more exemplary embodiments of the present disclosure.

FIG. 9 illustrates a perspective-view of a platform 200 of a locked-axle spring compression system coupled to a vehicle frame with a raised rail wheel, in accordance with one or more exemplary embodiments of the present disclosure. In one embodiment, once the actuators (e.g., hydraulic cylinders 212) are actuated via fluid provided via hoses 602 coupled to a gauge box 604, the journal box 102 can be lifted away from the platform 200, causing the coil spring pressure to be overcome and lifting the rail wheel 110 off the surface, as shown in FIG. 9. In one embodiment, the rail wheel 110 can be lifted at least a half-inch (½") off the rail to facilitate travel. For example, a wheel begins to lift off a surface at approximately 7500 psi, and at approximately 8500 psi, will raise a –9 spring to board, when a hydraulic cylinder is used.

Figure 10:
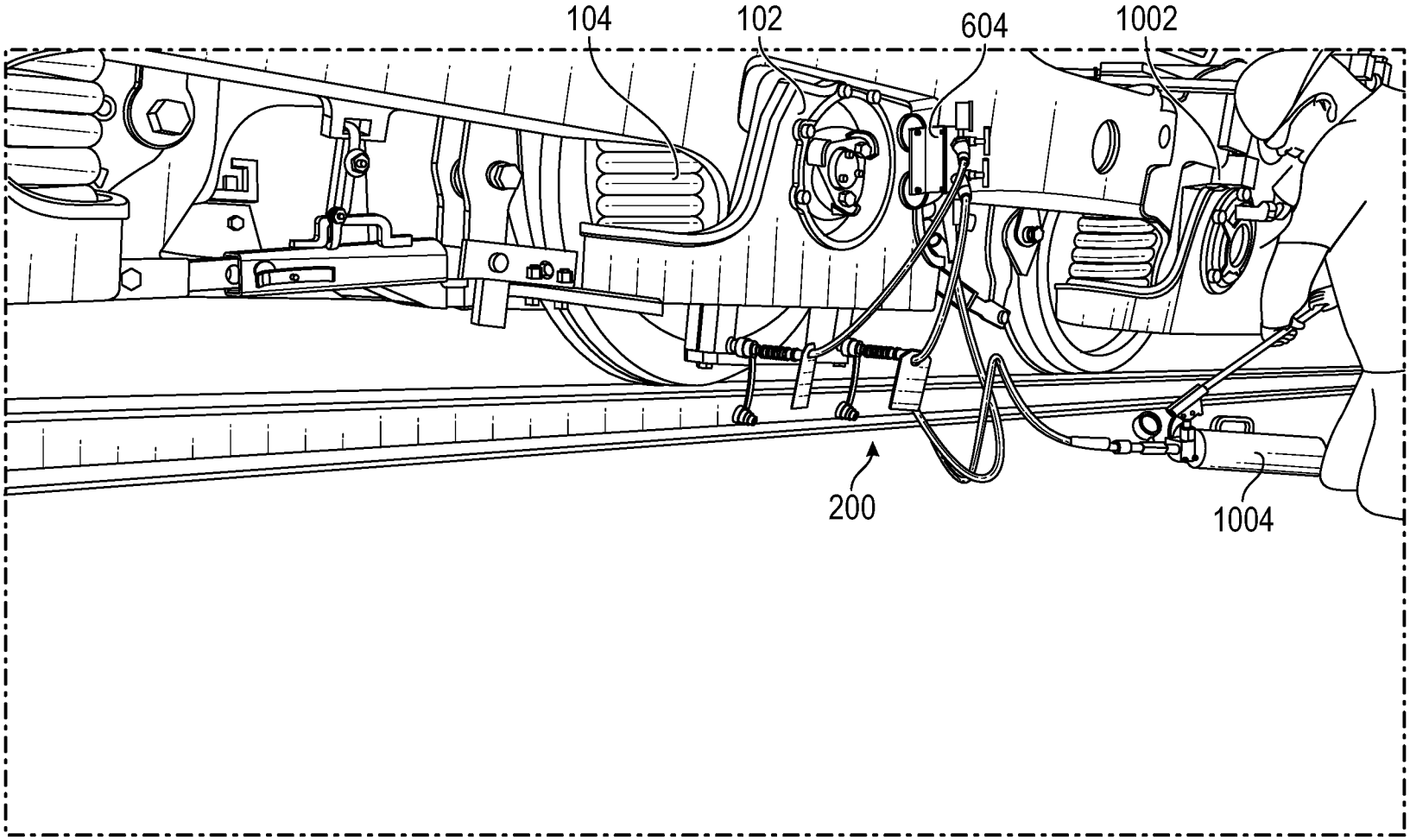
FIG. 10 illustrates a perspective-view of a locked-axle spring compression system with compressed coil springs, a pump, and a raised rail wheel, in accordance with one or more exemplary embodiments of the present disclosure.

FIG. 10 illustrates a perspective-view of a platform 200 of a locked-axle spring compression system with compressed coil springs 104, a pump 1004, and a raised rail wheel, in accordance with one or more exemplary embodiments of the present disclosure. In one embodiment, a pump 1004 can be operably coupled to a gauge box 604 indicating the pressure of each actuator deployed. For example, the pump can provide fluid to the gauge box, which in turn can distribute the fluid into each actuator to increase the pressure and cause an actuator ram to extend. The gauge box 604 can include a housing, an assembly of gauges, and/or hose adapters, or any suitable configuration thereof. The pump 1004 can be a hand pump, mechanical pump, electric pump, or other suitable pump capable of providing hydraulic flow to the actuator. As the actuator lifts the journal box 102 away from the platform 200 additional strain can be placed on a second (third, etc.) journal box near the lifted journal box 102. A spacer 1002 can ensure the extra force does not damage the second journal box and or its respective axle. For example, the spacer 1002 can be positioned between the second journal box and the truck frame 702 to ensure sufficient distance between the second journal box and the truck frame to maintain the train structure. In another embodiment, the spacer 1002 can be the j-blocks previously decoupled from the truck jaws 708. In another embodiment, the spacer 1002 can be a metal component or other suitable device. In another embodiment, the wheels on either side of the locked axle can be raised, or both wheels of a locked axle can be raised by installation of a platform on both sides of the rail vehicle.

Figure 11:
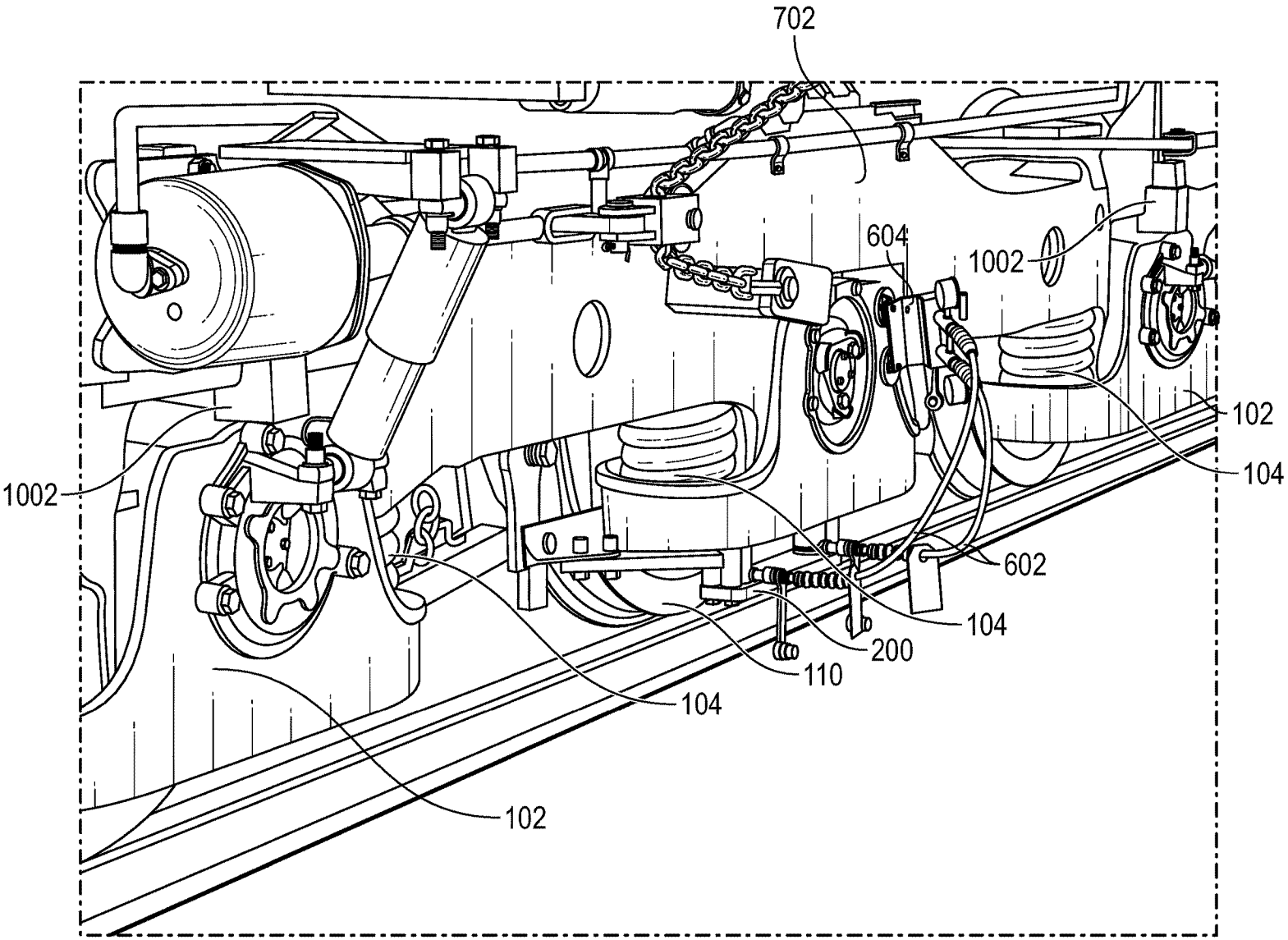
FIG. 11 illustrates a perspective-view of a locked-axle spring compression system with compressed coil springs, a pump, a spacer, and a raised rail wheel, ready for travel, in accordance with one or more exemplary embodiments of the present disclosure.

FIG. 11 illustrates a perspective-view of a platform 200 of a locked-axle spring compression system with compressed coil springs 104, a pump 1004, a spacer 1002, and a raised rail wheel 110, ready for travel, in accordance with one or more exemplary embodiments of the present disclosure. In one embodiment, once the spacers are inserted proximate nearby journal boxes, the journal box 102 of a locked-axle is lifted, the coil springs 104 compressed, and the locked-axle rail wheel 110 lifted off the rail, the pump and associate pump hose can be disconnected from the gauge box 604. The hoses between the actuators 212 and the gauge box 604 can be retained to monitor the pressure of the actuators 212 as the train travels. The magnets of the gauge box 604 are strong enough to secure the gauge box 604 to the journal box 102 during travel.

Figure 12:
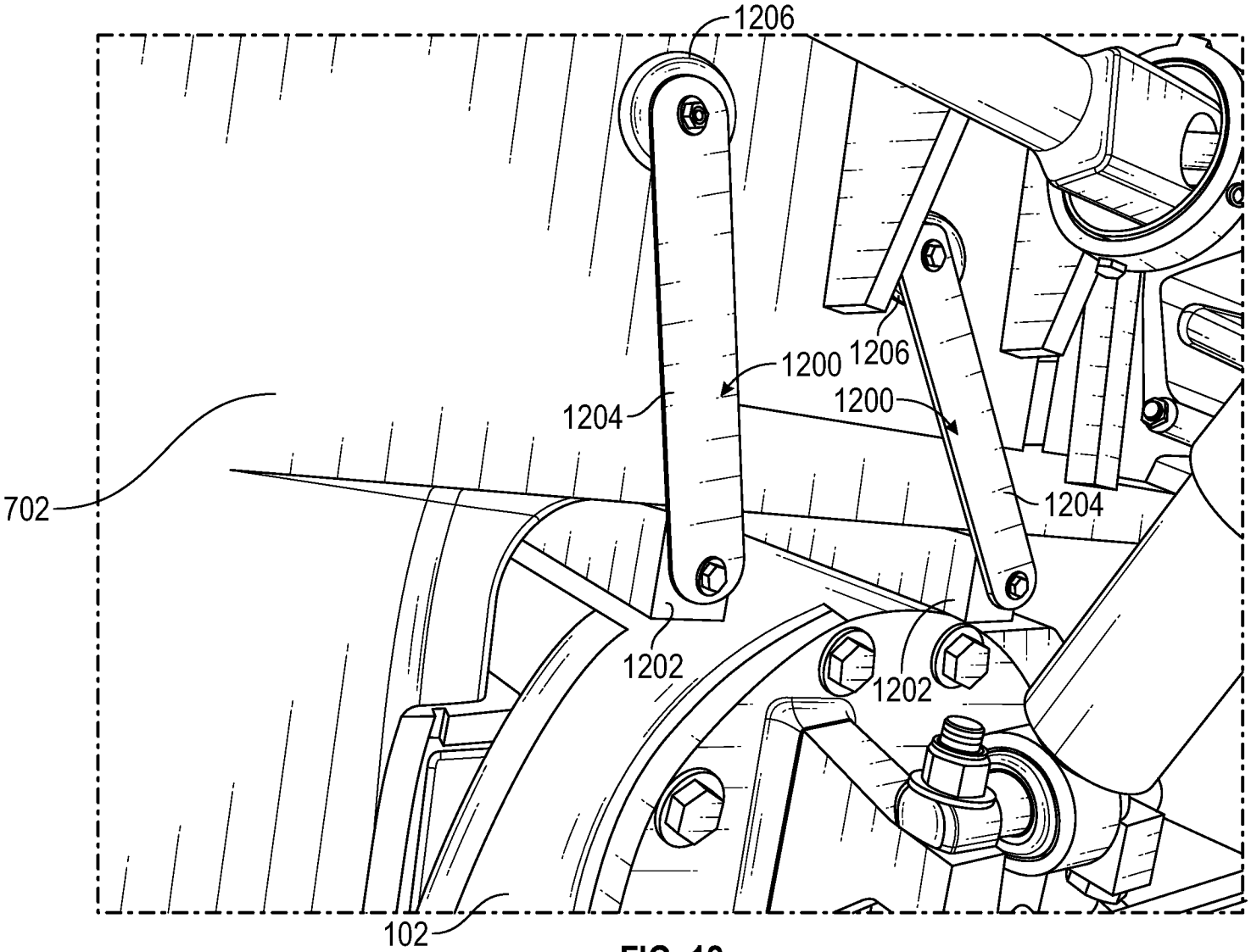
FIG. 12 illustrates a side-view of a portion of a train wheel assembly with spacers, in accordance with one or more exemplary embodiments of the present disclosure.

FIG. 12 illustrates a side-view of a portion of a train wheel assembly with spacers 1200, in accordance with one or more exemplary embodiments of the present disclosure. In one embodiment, the spacers 1200 can include a block 1202, a retention arm 1204, and a coupler 1206. In another embodiment, the block 1202 can be a block of any size, shape, and suitable material sufficient to maintain a gap between the truck frame 702 and the journal box 102. For example, by maintaining a gap between the truck frame 702 and the journal box 102, the spacer 1200 can prevent damage to other rail vehicle components due to the raised locked-axle wheel. In another embodiment, blocks 1202 keep the coupler height from changing more than ½". In another embodiment, a retention arm 1204 can be operably coupled to the block 1202 and the coupler 1206. The retention arm 1204 can be made of metal, plastic, or other suitable material. The coupler 1206 can be a magnet, hook, chain, or other suitable device. For example, the block 1202 is maintained in place via the retention arm 1204, secured to the rail vehicle via the coupler 1206.

The present disclosure achieves at least the following advantages:

1. Safer and faster (no crane and no cut pinions);
2. Reduced costs and manpower; and
3. Fewer delays resulting in increased network speed.

Persons skilled in the art will readily understand that advantages and objectives described above would not be possible without the particular combination of structural components and mechanisms assembled in this inventive system and described herein. Moreover, the particular choice of components may be governed by the specific objectives and constraints placed on the implementation selected for realizing the concepts set forth herein and in the appended claims.

The description in this patent document should not be read as implying that any particular element, step, or function can be an essential or critical element that must be included in the claim scope. Also, none of the claims can be intended to invoke 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," "processing device," or "controller" within a claim can be understood and intended to refer to structures known to those skilled in the relevant art, as further modified or enhanced by the features of the claims themselves, and can be not intended to invoke 35 U.S.C. § 112(f). Even under the broadest reasonable interpretation, in light of this paragraph of this specification, the claims are not intended to invoke 35 U.S.C. § 112(f) absent the specific language described above.

The disclosure may be embodied in other specific forms without departing from the spirit or essential characteristics thereof. For example, each of the new structures described herein, may be modified to suit particular local variations or requirements while retaining their basic configurations or structural relationships with each other or while performing the same or similar functions described herein. The present embodiments are therefore to be considered in all respects as illustrative and not restrictive. Accordingly, the scope of the inventions can be established by the appended claims rather than by the foregoing description. All changes which come within the meaning and range of equivalency of the claims are therefore intended to be embraced therein. Further, the individual elements of the claims are not well-understood, routine, or conventional. Instead, the claims are directed to the unconventional inventive concept described in the specification.

What is claimed is:

1. A locked-axle rail wheel spring compression system, comprising:

a platform, including:

a base plate having a top side and a bottom side, with one or more bolt holes disposed therethrough;

an extender having a bolt channel, coupled to the top side of the base plate, a bolt disposed through the bolt hole from the bottom side of the base plate and through the bolt channel, and an actuator coupled to the top side of the base plate; and a gauge box having a gauge coupled to the actuator to monitor and apply fluid to the actuator.

2. The system of claim 1, further comprising at least one actuator hole disposed through the base plate and configured to receive an actuator screw or stud.

3. The system of claim 1, wherein the actuator is disposed between the base plate and a vehicle structure.

4. The system of claim 1, wherein the bolt couples the base plate and the extender to a vehicle structure.

5. The system of claim 1, wherein the actuator extends a ram to exert a force on a journal box.

6. The system of claim 5, wherein the force compresses a coil spring disposed proximate the journal box.

7. The system of claim 1, wherein the gauge box includes one or more magnets to adhere the gauge box to a train.

8. The system of claim 1, wherein the gauge box indicates the pressure exerted or maintained by the actuator.

9. The system of claim 1, further comprising a pump operably coupled to the gauge box.

10. The system of claim 1, further comprising a hose configured to couple the gauge box to an external device.

11. A locked-axle spring compression system, comprising:

a vehicle frame;

a locked-axle spring compression system having a base plate, an extender having a bolt channel, and an actuator coupled to the vehicle frame proximate a locked-axle rail wheel; and a gauge box having a gauge coupled to the actuator to monitor and apply fluid to the actuator.

12. The system of claim 11, further comprising at least one actuator hole disposed through the base plate and configured to receive an actuator screw or stud.

13. The system of claim 11, wherein the actuator is disposed between the base plate and the vehicle frame.

14. The system of claim 11, further comprising a bolt disposed through the base plate and the extender and coupled to the vehicle frame.

15. The system of claim 11, wherein the actuator extends a ram to exert a force on a train structure.

16. The system of claim 15, wherein the force compresses a coil spring disposed proximate the train structure.

17. The system of claim 11, wherein the gauge box includes one or more magnets to adhere the gauge box to a train.

18. The system of claim 11, wherein the gauge box indicates the pressure exerted or maintained by the actuator.

19. The system of claim 11, further comprising a pump operably coupled to the gauge box.

20. The system of claim 11, further comprising a hose configured to couple the gauge box to an external device.

* * * * *